United States Patent [19]

Hutzenlaub

[11] Patent Number: 4,838,060

[45] Date of Patent: Jun. 13, 1989

[54] TUBULAR KEY AND CORRESPONDING LOCK HOUSING KEY ENTRY CONSTRUCTION

[75] Inventor: John T. Hutzenlaub, River Grove, Ill.

[73] Assignee: Fort Lock Corporation, River Grove, Ill.

[21] Appl. No.: 193,780

[22] Filed: May 12, 1988

[51] Int. Cl.[4] ..... E05B 27/04

[52] U.S. Cl. ..... 70/491; 70/404

[58] Field of Search ..... 70/403, 404, 491

[56] References Cited

U.S. PATENT DOCUMENTS

| | | | |
|---|---|---|---|
| 2,982,121 | 5/1961 | George | 70/404 |
| 3,903,720 | 9/1975 | Scherbing | 70/363 |
| 4,069,695 | 1/1978 | Frank | 70/491 |
| 4,191,036 | 3/1980 | Steinbach | 70/404 |

FOREIGN PATENT DOCUMENTS

| | | | |
|---|---|---|---|
| 2450928 | 11/1980 | France | 70/403 |

*Primary Examiner*—Robert L. Wolfe

*Attorney, Agent, or Firm*—Leydig, Voit & Mayer

[57] ABSTRACT

A tubular key and axial pin tumbler lock construciton with an annular keyway wherein the key shank has a plurality of longitudinally extending grooves positioned between the circumferential key cut receiving areas and the lock housing outer periphery of the key entry way is provided with corresponding shaped projections which allow the tubular key containing the grooves to pass into the entry way. The tubular key shank also includes a transverse annular recess spaced inwardly from the forward end of the key such that when the key is inserted to its lock operating position, the key grooves and housing projections are free of one another to allow the key to rotate within the lock.

The tubular key construction can be utilized with conventional existing tubular lock constructions and the key grooves and housing entry projections may be varied in shape or locations so that they are combinated to permit only certain or select keys to be used with a certain lock or groupings of locks.

11 Claims, 1 Drawing Sheet

TUBULAR KEY AND CORRESPONDING LOCK HOUSING KEY ENTRY CONSTRUCTION

BACKGROUND OF THE INVENTION

The present invention relates generally to tubular keys for axial pin tumbler locks, and, more particularly, relates to an improved construction for tubular keys and the corresponding lock housing key entry way which restricts application of conventional tubular keys and tools from access to a particular lock while still permitting the tubular key of the present invention to be used for conventional tubular locks.

FIELD OF THE INVENTION

Axial pin tumbler locks which are tubular key operated have been widely used for security purposes and are most frequently used in applications such as vending, dispensing machines and alarm systems.

Conventionally, tubular locks are based upon a design including an outer housing presenting an annular keyway between the housing and a locking spindle rotatably mounted within the housing. The spindle is normally prevented from rotation by axially movable sets of tumbler pins which extend between a sleeve having tumbler bores mounted to the spindle and a stationery sleeve having tumbler bores fixedly anchored to the housing. The spindle sleeve and housing sleeve define a shear plane therebetween at which all tumbler pins must be precisely aligned to permit the spindle to turn and operate the lock.

Conventional tubular keys utilized with such locks have been generally made up of two components, i.e., a flat handle portion and a cylindrical shank which is press fit or otherwise secured to the handle portion. The cylindrical shank is commonly a machined member made from solid rod stock by several cutting operations. These include cutting a stepped and slotted portion adjacent the shank end receiving the handle and drilling a central opening forming the hollow tubular portion at the opposite forward end thereof. The key cuts or bittings are made around the periphery of the tubular forward end and there may also be provided an outwardly as well as inwardly extending lugs which respectively enter slots in the housing and spindle to define key entry and pull positions as well as polarization. Such keys may be made of two pieces as shown and described, for example, in Morris Falk U.S. Pat. No. 3,961,507 assigned to the assignee of the present invention, or the tubular keys can be integrally and unitarily formed as disclosed and claimed in U.S. Pat. Nos. 3,509,748 and 3,744,286.

With the advent of improved and more highly pick resistant tubular lock constructions such as those of Gale Johnson U.S. Pat. No. 4,716,749 issued Jan. 5, 1988 and Gale Johnson Continuation-In-Part application Ser. No. 070,924, filed July 7, 1987 for "High Security Pin Tumbler Lock", it has become desirable to provide a tubular key which is more distinctly associated with the new lock constructions. Also, there is a need for the lock itself to restrict receipt of the numerous existing conventional keys and picking tools which have been so freely available for conventional tubular locks.

SUMMARY OF THE INVENTION

It is the general aim of the present invention to provide an improved tubular key construction especially for use with high security axial pin tumbler locks which is uniquely coordinated with such locks so that the new key entry is permitted while conventional tubular keys and tools are foreclosed from entry into the locks. It is a related object to provide such an improved tubular key construction which itself is still capable of being utilized even with conventional tubular locks such that existing standard key cutting machines and other standard production equipment and lock components may still be utilizable with such tubular keys.

It is a further object of this invention to provide an improved tubular key construction of the above type that readily allows for different positions of key insertion and key pulls without substantial modification of the lock housing construction.

These and other objects of this invention are realized by providing the outer periphery of the tubular key with a plurality of longitudinally extending grooves positioned between the circumferential key cut receiving areas and the lock housing outer periphery of the key entry way is provided with corresponding shaped projections which allow the tubular key containing the grooves to pass into the entry way. The tubular key shank also includes a transverse annular recess spaced inwardly from the forward end of the key such that when the key is inserted to its lock operating position, the key grooves and housing projections are free of one another to allow the key to rotate within the lock.

The illustrative tubular key construction is uncomplicated and economical to produce and can even easily be utilized with conventional existing tubular lock constructions. One important aspect of the present invention is that the key grooves and housing entry projections may be varied in shape or locations so that they are in effect combinated to permit only certain or select keys to be used with a certain lock or groupings of locks.

BRIEF DESCRIPTION OF THE DRAWINGS

The invention and further objects and advantages thereof will be made apparent by reference to the ensuring description when taken in conjunction with the accompanying drawings wherein.

DESCRIPTION OF THE PREFERRED EMBODIMENT

Figure 1:
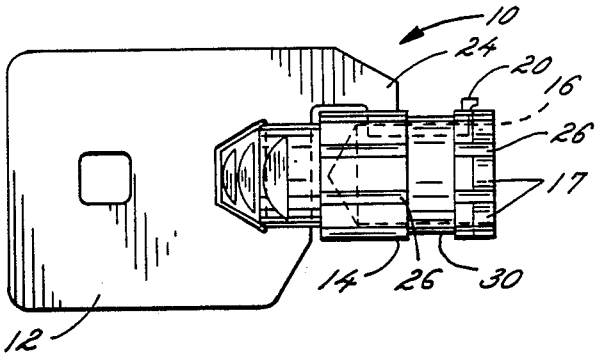
FIG. 1 is a side view of a tubular key incorporating the features of: the present invention.
Figure 2:
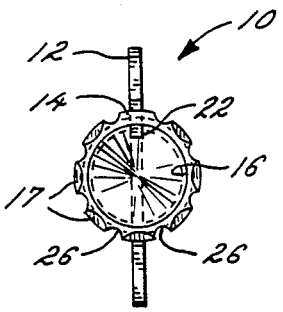
FIG. 2 is an end view taken along the line 2—2 in FIG. 1.

Turning to the drawings there is shown in FIG. 1 a tubular key indicated generally at 10, which is here illustrated as a two part key having a handle 12 and a tubular barrel or shank 14. The barrel 14 includes a longitudinal hollow chamber 16 which telescopes over a lock spindle in use of the key. Around the forward end of the barrel periphery are illustrated a plurality of key notches 17 which are typically cut to different longitudinal depths according to the code pin combinations of a lock which is to be operated by the key.

The handle portion 12 includes a forwardly projecting portion 18 having a radially outwardly extending tab 20 and a radially inwardly extending tab 22. A pointer 24 aligned with tabs is formed on the key handle to facilitate alignment for insertion into a lock.

In accordance with the present invention, the tubular key 10 includes the plurality of longitudinally extending grooves 26 positioned about, and projecting radially inward from, the periphery of the barrel 14 and disposed between key notches 17. As here shown, the grooves 26 are arcuate in cross section, however, it will be appreciated that the grooves 26 can be otherwise shaped in various geometric cross-sectional configurations as well as varied in number and position around the key barrel periphery located between the key notches 17. The barrel 14 is also provided with a transverse annular recess 30 located inwardly spaced from the forward end of the barrel and tab 20 which permits the key to rotate after the key grooves 26 are clear in the lock entry way. The recess 30 is desirably positioned inward of the forward end of the barrel by at least a distance slightly greater than the longest key notch 17.

Figure 3:
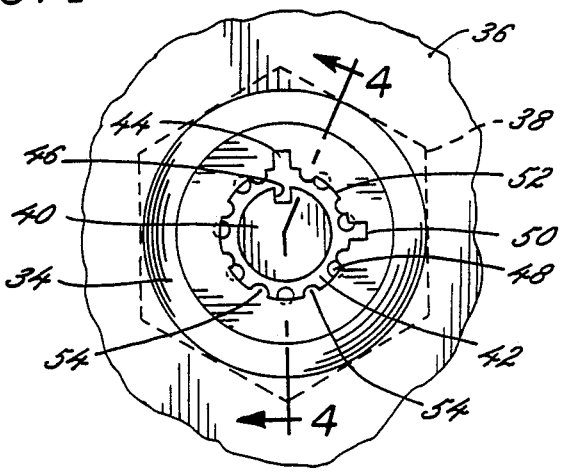
FIG. 3 is a front end view of a lock and housing used with a key of FIG. 1.
Figure 4:
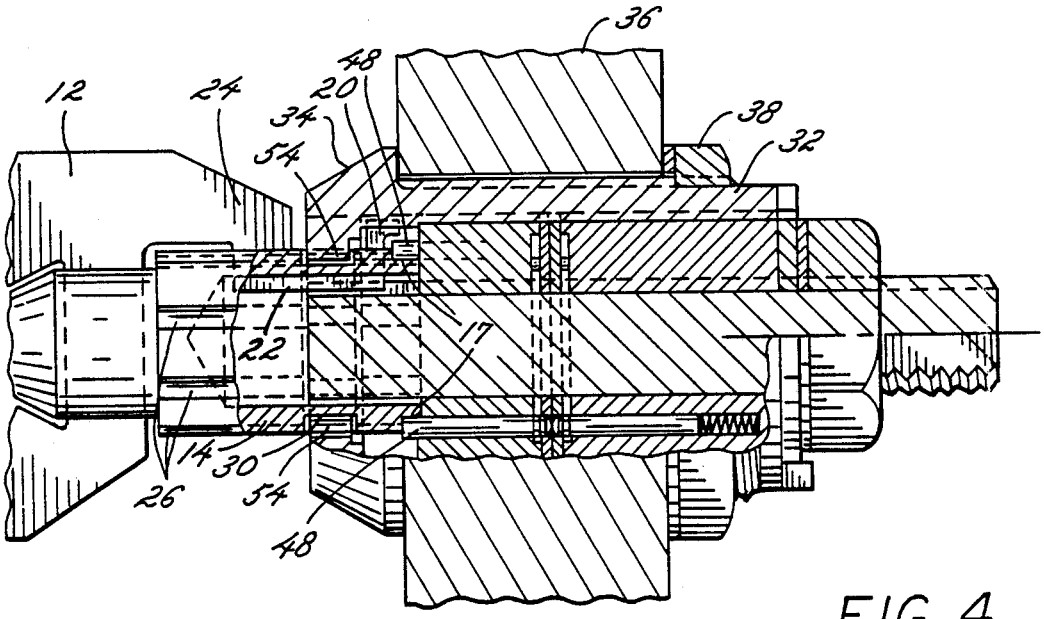
FIG. 4 is a magnified cross-sectional view taken along the lines 4—4 in FIG. 3, but with the tubular key inserted within the key entry on a lock housing of a axial pin tumbler lock according to the preferred embodiment of this invention.

In accordance with another aspect of the present invention, referring to FIGS. 3 and 4, an exemplary tumbler lock is shown including an outer tubular housing 32 having a threaded outer surface and including a frusto conical head 34, the lock being mounted into a support member 36 and held in place by a retaining nut 38. An elongated spindle 40 is rotatably supported within the tubular body or housing 32. For details of the internal locking mechanism reference is made to the aforementioned Johnson U.S. Pat. No. 4,716,749 and co-pending U.S. application Ser. No. 070,924 filed July 7, 1987. Suffice it to say that locking and unlocking action is brought about by insertion of the key in the key way 42 such that key tab 20 enters the housing slot 44 and inward tab 22 engages with the slot 46 on the spindle whereupon the key notches 17 encounter the combinated pins 48. Upon complete insertion of the key, the tumbler pins are aligned with the shear plane and the spindle can be rotated to an unlocked position which as shown in FIG. 3 is provided with another housing pull slot 50 providing a key pull at the 3 o'clock position.

In keeping with the present invention, the periphery of the housing bore 52 which defines a cylindrical surface and the outer diameter of the key entry way 42 is provided with a plurality of longitudinally extending projections 54 which protrude radially inward from the cylindrical periphery surface and correspond in shape, number and circumferential location with the key barrel grooves 26. The projections 54 are preferably located between each tumbler pin and the angular positioning is such that the corresponding projections 54 will allign with key grooves 26 for the desired locations of key insertion and removal. It will be noted that when the key is inserted into the lock the annular recess 30 on the key provides rotational clearance from the projections 54 thereby allowing the key to be rotated. Conventional tubular keys which do not incorporate the longitudinal grooves 26 and transverse recess 30 would be blocked against insertion and operation of the lock having the projections 54 in the key way 42. On the other hand, the key of the present invention can still be utilized with previously existing tubular locks where there is a clear annular key way.

It will be apparent that varying combinations of key groove shapes and positions may be provided together with key way projections of corresponding shapes and positions such that specific keys may be made to fit only certain locks or a series of locks as well as enabling selected groupings of locks to be coordinated with certain keys.

I claim:

1. For uses with an axial pin tumbler lock having an annular keyway and axially directed combination pins, a tubular key comprising a handle portion and a cylindrical shank portion, the forward end of said cylindrical shank portion being adapted to receive a plurality of circumferentially spaced notches of different longitudinally extending lengths corresponding to the requisite axial movement of the lock combination pins, said shank having one or more longitudinally extending grooves projecting radially inward from a peripheral cylindrical portion of said shank circumferentially located between said shank peripheral portions which receive the combinated notches and a transverse annular recess positioned inwardly from the shank forward end of the key and inwardly of the longest longitudinal combination notch provided on the shank.

2. A tubular key as claimed in claim 1 wherein a longitudinally extending groove is located between each angular position provided for the combinated notches.

3. A tubular key as claimed in claim 1 wherein said one or more longitudinal grooves are semicircular in cross section.

4. A tubular key as claimed in claim 1 wherein said shank forward end includes a radially outwardly extending tab.

5. A tubular key as claimed in claim 1 wherein said key shank forward end includes a radially inwardly extending tab.

6. In an axial pin tumbler lock having an annular keyway and axially directed combination pins, the improvement comprising said keyway being defined by a cylindrical body having a bore of a first diameter and a spindle positioned within said bore of a second and smaller diameter, the periphery of said body bore defining a cylindrical surface having one or more longitudinally extending projections protruding radially inward from said cylindrical periphery surface and positioned in the keyway at an angular location between at least a pair of the axially directed combination pins.

7. An axial pin tumbler lock as claimed in claim 6 wherein a keyway projection is located between each pair of combination pins included in the lock.

8. An axial pin tumbler lock as claimed in claim 6 wherein said one or more projections is semicircular in cross section.

9. A tubular lock and operating key, comprising in combination, a cylindrical body having a first diameter bore, a spindle positioned with said bore having a second and smaller diameter defining an annular key entryway between the spindle and body bore, the periphery of said body bore defining a cylindrical surface having a plurality of longitudinally extending projections protruding radially inward from said cylindrical periphery surface and positioned in the keyway, said spindle having means including axially directed combination pins at circumferentially spaced positions in association with said keyway, said tubular key including a handle portion and a cylindrical shank portion, the forward end of said shank portion having a plurality of circumferentially spaced notches of varying longitudinally extending lengths corresponding to the requisite movement of the lock combination pins to rotate the spindle, said shank including a plurality of longitudinally extending grooves projecting radially inward from a cylindrical peripheral portion of said shank circumferentially located between the combinated key notches, a transverse annular recess positioned inwardly from the shank forward end of the key and inwardly of the longest longitudinal combination notch on the shank so that the keyway projections and key grooves are clear of one another when the key shank is operable inserted in the lock keyway, and said key grooves correspond in shape and relative locations to those of the keyway projections on said body bore periphery.

10. The lock and key combination as claimed in claim 9 wherein said key grooves and said body bore projections in the keyway are semicircular in cross section.

11. The lock and key combination as claimed in claim 9 wherein a groove is located between each key notch and a body bore projection is positioned in the keyway between each spindle carried combination pin circumferential location.

* * * * *

UNITED STATES PATENT AND TRADEMARK OFFICE

CERTIFICATE OF CORRECTION

PATENT NO. : 4,838,060

DATED : June 13, 1989

INVENTOR(S) : John T. Hutzenlaub

It is certified that error appears in the above-identified patent and that said Letters Patent is hereby corrected as shown below:

In Claim 1, (at Col. 4, line 16), change "peripheral cylindrical" to --cylindrical peripheral--.

In Claim 9, (at Col. 5, l. 10), change "operable" to --operably--.

Signed and Sealed this

Twentieth Day of March, 1990

*Attest:*

JEFFREY M. SAMUELS

*Attesting Officer*

*Acting Commissioner of Patents and Trademarks*